US009788637B2

(12) United States Patent
Hauger

(10) Patent No.: US 9,788,637 B2
(45) Date of Patent: Oct. 17, 2017

(54) APPLICATOR WITH A SLOTTED TUBE AND NOTCHES

(71) Applicant: GEKA GmbH, Bechhofen (DE)

(72) Inventor: Christian Hauger, Donaueschingen (DE)

(73) Assignee: GEKA GmbH, Bechhofen (DE)

( * ) Notice: Subject to any disclaimer, the term of this patent is extended or adjusted under 35 U.S.C. 154(b) by 0 days.

(21) Appl. No.: 14/748,866

(22) Filed: Jun. 24, 2015

(65) Prior Publication Data

US 2015/0366326 A1 Dec. 24, 2015

(30) Foreign Application Priority Data

Jun. 24, 2014 (DE) ..... 20 2014 102 873 U

(51) Int. Cl.

| | |
|---|---|
| ***A46B 7/02*** | (2006.01) |
| ***A45D 40/26*** | (2006.01) |
| ***A46B 9/02*** | (2006.01) |
| ***A46B 15/00*** | (2006.01) |

(52) U.S. Cl.

CPC ..... *A45D 40/267* (2013.01); *A46B 7/023* (2013.01); *A46B 9/021* (2013.01); *A46B 15/0059* (2013.01); *A46B 2200/106* (2013.01); *A46B 2200/1053* (2013.01)

(58) Field of Classification Search

CPC ..... A45D 40/265; A45D 40/267; A46B 7/06; A46B 9/021; A46B 13/08; A46B 9/10; A46B 2200/106; A46B 2200/1053; A46B 7/023

USPC ..... 132/218; 15/187, 201, 188

See application file for complete search history.

(56) References Cited

U.S. PATENT DOCUMENTS

| | | | | | |
|---|---|---|---|---|---|
| 52,833 | A * | 2/1866 | Engle | A46B 7/06 | 15/201 |
| 883,548 | A * | 3/1908 | Laitner | A46B 7/06 | 15/201 |
| 916,071 | A * | 3/1909 | Watanabe | A46B 7/06 | 15/201 |
| 1,661,713 | A * | 3/1928 | Barker | 15/188 | |
| 1,687,079 | A * | 10/1928 | Barker | A46B 9/04 | 15/110 |
| 2,254,365 | A * | 9/1941 | Griffith | A46B 7/02 | 15/167.1 |
| 2,569,908 | A * | 10/1951 | Twitty | A45D 24/16 | 132/120 |
| 2,920,334 | A * | 1/1960 | Keller | A45D 24/04 | 15/176.1 |

(Continued)

FOREIGN PATENT DOCUMENTS

| | | | |
|---|---|---|---|
| DE | 202012103567 | U1 | 2/2014 |
| WO | 2010149366 | A1 | 12/2010 |
| WO | 2014044725 | A1 | 3/2014 |

*Primary Examiner* — Todd E Manahan
*Assistant Examiner* — Jennifer Gill

(57) ABSTRACT

A cosmetics applicator having a core bearing application organs in the form of bristles and/or comb teeth, wherein the core is formed by a slotted tube equipped with bristles and/or comb teeth on its outer circumferential surface, and the slotted tube comprises at least one weakening groove extending in a direction parallel to the longitudinal axis of the tube, which facilitates curling of the tube under the influence of forces acting from outside on the tube or expansion of the tube by means of an eccentric arranged within it.

9 Claims, 6 Drawing Sheets

(56) References Cited

U.S. PATENT DOCUMENTS 3,188,672 A * 6/1965 Gary ..... A46B 5/0025 15/167.1
4,257,434 A * 3/1981 Wahl ..... A45D 1/04 132/118
4,267,851 A * 5/1981 Plaisted ..... A45D 1/04 132/229
4,423,531 A * 1/1984 Wall ..... A46B 3/005 132/126
4,660,582 A * 4/1987 Taylor ..... A45D 40/26 132/218
4,744,377 A * 5/1988 Dolan, Jr. ..... A45D 40/265 132/218
4,866,249 A * 9/1989 Howard ..... A45D 1/04 132/229
5,114,214 A * 5/1992 Barman ..... A46B 5/0025 15/167.2
5,284,168 A * 2/1994 Klinkhammer ..... A46B 5/002 132/308
5,325,878 A * 7/1994 McKay ..... A45D 24/24 132/108
5,465,450 A * 11/1995 Humphries ..... A46B 5/0079 15/144.1
5,839,149 A * 11/1998 Scheier ..... A46B 5/0029 15/167.1
6,219,874 B1 * 4/2001 van Gelder ..... A46B 5/0025 15/167.1
7,231,926 B2 * 6/2007 Kim ..... A46B 3/18 132/120
7,497,219 B2 * 3/2009 Gueret ..... A45D 33/006 132/200
D664,361 S * 7/2012 Edmondson ..... D4/128
2008/0006287 A1 * 1/2008 Gueret ..... A45D 40/265 132/218
2009/0276973 A1 * 11/2009 Bouix ..... A45D 40/265 15/206
2011/0094534 A1 * 4/2011 Bickford ..... A45D 34/045 132/218
2011/0155162 A1 * 6/2011 Arditty ..... A45D 40/08 132/200
2011/0164914 A1 * 7/2011 Caulier ..... A46B 3/18 401/129
2011/0299913 A1 * 12/2011 Simard ..... A46B 9/005 401/268
2012/0167910 A1 * 7/2012 Weigel ..... A45D 40/265 132/218
2015/0305477 A1 * 10/2015 Malvar ..... A45D 40/267 15/207.2

* cited by examiner

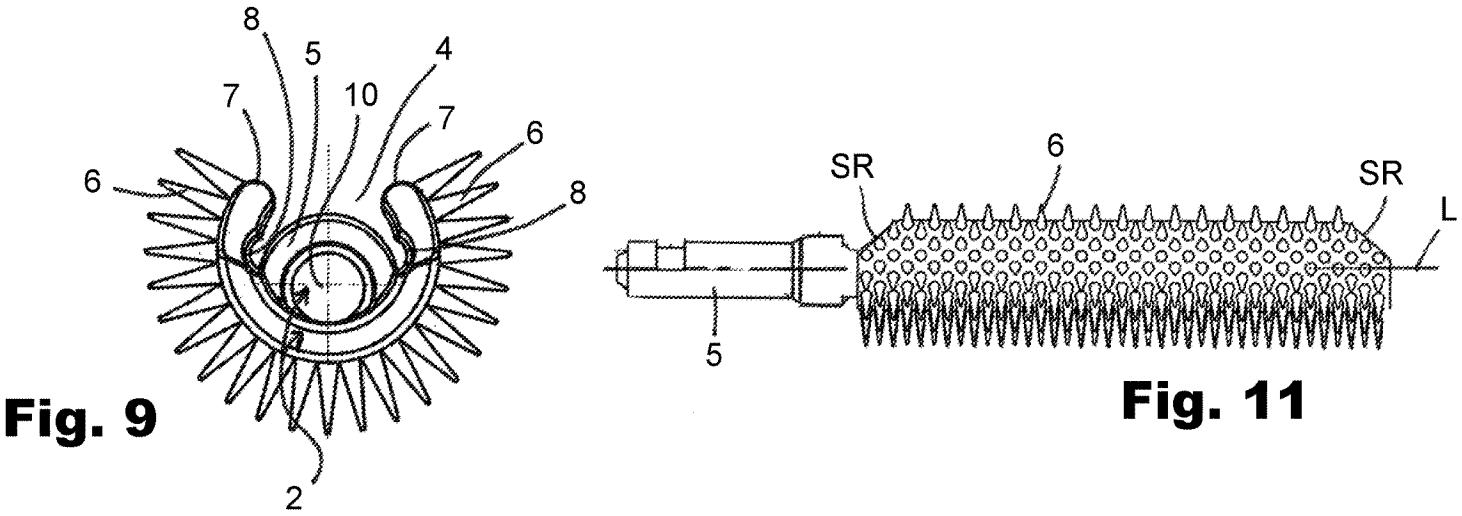
Fig. 11
Fig. 9
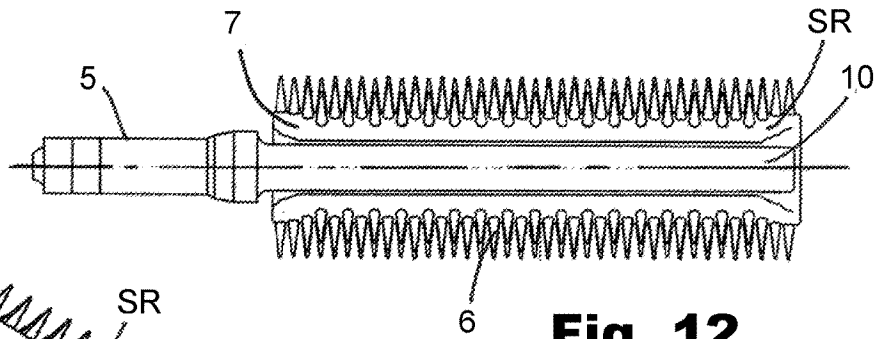
Fig. 12
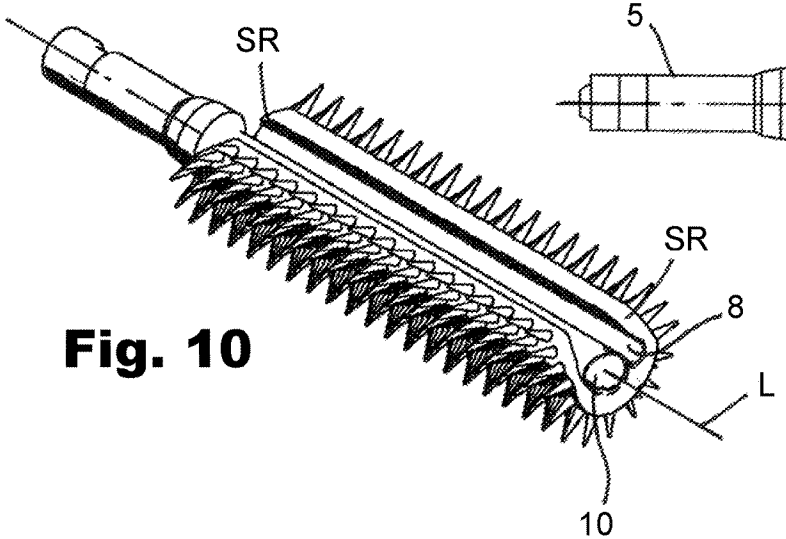
Fig. 10

APPLICATOR WITH A SLOTTED TUBE AND NOTCHES

FIELD OF THE INVENTION

The invention relates to an applicator. In particular, it relates to applicators for applying a cosmetic preferably in the form of mascara.

BACKGROUND OF THE INVENTION

In the prior art, all manner of cosmetics applicators have been known. As a rule, as the core diameter of the applicator increases, the diameter of the stripper and the diameter of the opening in the bottleneck also have to increase. This applies, in particular, to applicators where the core and the bristles supported by it, are made of an injection-molded plastic material. Since injection-molded bristles in particular often only have limited bend-recovery capability, they tend to become damaged after within just a short time by the action of withdrawing the applicator from the cosmetics reservoir, whereby the core, from which they protrude, is forced through a stripper and/or bottleneck that is actually too tight for its diameter.

Therefore, if an applicator has a particularly large core diameter, usually, a special stripper and a reservoir having a bottleneck specifically adapted to the large core diameter, have to be specially created. Specialized tools will have to be designed or stored, which causes extra expense.

It is thus the object of the present invention to create a cosmetics applicator, which is more independent than hitherto possible from the free diameter of the available stripper and/or the diameter of the neck of the available cosmetics reservoir, and has improved adaptability to each respective stripper diameter or has further improved handling.

SUMMARY OF THE INVENTION

The object is achieved by a cosmetics applicator comprising a core bearing the application organs in the form of bristles and/or comb teeth. The core according to the present invention is formed by a slotted tube equipped with bristles and/or comb teeth on its outer circumferential surface. The slotted tube comprises at least one weakening groove extending in a direction parallel to the longitudinal axis of the tube, which facilitates curling of the tube under the influence of forces acting from outside on the tube.

A weakening groove is preferably not any recess in the inner circumferential surface of the tube. Recesses which do not cause any practically relevant weakening are irrelevant. Preferably, a recess in terms of the present invention is a recess having sufficient depth to locally weaken the wall of the slotted tube to such an extent that the amount of local deformation under a predetermined force increases by 25%, more preferably by at least 40%.

A weakening groove extending in parallel to the longitudinal axis is in each case understood to be a groove extending in parallel to the longitudinal axis L of the applicator, or the slotted core, within an angular tolerance of +/−1.5°. As an exception, larger deviations from the parallel, of +/−6° are also allowable, but not, however, preferred.

The at least one weakening groove according to the invention allows the folding behavior, or the tendency of the applicator to curl as it passes through the neck of the receptacle or the stripper, to be directly influenced. Simultaneously, the weakening groove can also be used to locally destabilize the slotted groove in such a way that the applicator can be elastically deformed during its intended application, surprisingly giving rise to a novel application behavior, which has found wide acceptance among test persons.

Preferably at least two, ideally even three weakening grooves are present extending in parallel to the longitudinal axis, allowing the deformation behavior of the slotted tube to be particularly advantageously influenced. Ideally, the weakening grooves are dimensioned and distributed along the circumference of the slotted tube in such a way that the radius of curvature of the slotted tube is no longer constant after curling, but is locally deviant. In this way, stripping of the bristles borne on the outer circumference of the slotted tube has the result that areas are stripped to various degrees, which enhances application variability in an extremely attractive manner, since the applicator only needs to be turned back and forth slightly in order to either apply more substance and to exert less combing action, or vice versa.

For the same reason it is particularly advantageous if two weakening grooves are essentially diametrically opposed to each other on the tube circumference with respect to the imagined central axis of the tube. The latter is the case if the weakening grooves are at an angle of 90°+/−15°, and more preferably an angle of 90°+/−5°, with respect to the circumference of the slotted tube.

Ideally, the weakening grooves are opposed in such a manner that two wing-like tube segments are separated from the rest of the tube, wherein one is the mirror image of the other and the two are otherwise identical.

In the context of the other features described in this disclosure, but also alone, independently, protection is sought for a cosmetics applicator comprising a core bearing the application organs in the form of bristles and/or comb teeth, wherein the core is formed by a slotted tube equipped with bristles and/or comb teeth on its outer circumferential surface, wherein a support core forming a further component part of the core is formed along the hollow interior of the slotted tube, which integrally transitions into the inner circumference of the slotted tube along a part of its outer circumference.

It is particularly preferred if the slotted tube is made of a first plastic material and the support core is made of a different, second plastic material, wherein the first plastic material is preferably more flexible than the second plastic material. In this way, an applicator can easily be provided, whose slotted tube is particularly flexible in the circumferential direction, while at the same time, however, being essentially rigid in the direction of its longitudinal axis L, and which can easily be pushed or pulled through tight strippers or receptacle necks without the risk of any undesirable buckling.

It is particularly preferred if the first plastic material forming the support core is a soft elastic plastic material, a soft elastomer plastic or a rubber-like plastic material.

In a particularly preferred embodiment, the two different plastic materials are processed or joined by means of over-molding. Such over-molding characteristically leaves physical traces on the part thus created. As a result of the over-molding, the first and second plastic material are fused or adhesively bonded at the place where they meet at the transition of the inner circumference of the slotted tube to the outer circumference of the support core, at least when viewed under the microscope, in a manner typical for over-molding, which results when the one plastic material in a liquid molten state joins the other, at least partially solidified, plastic material.

The diameter of the support core is usually chosen in such a way that it is substantially smaller than the free diameter defined to the outside by the slotted tube. Most of the time, the diameter of the support core occupies less than 30% of the cross-sectional area defined by the slotted tube.

A particular embodiment, for which protection is sought, in particular also in an isolated independent manner, is characterized by a support core with a particularly large diameter—the support core practically completely fills the diameter defined by the slotted tube so that the outer circumferential surface of the support core forms an annular gap with the inner circumferential surface of the slotted tube over an angle of more than 120°, wherein the annular gap has a maximum height of 1 mm, more preferably only 0.75 mm, in the radial direction preferably along most of its extension in the circumferential direction.

Such an applicator cannot curl, but exhibits an interesting flexibility in the radial direction, not only, but in particular when at least one, preferably at least two weakening grooves are provided on the inner surface of the slotted tube.

In the present exemplary embodiment, it can be provided that the support core extends through the slot of the tube. In that case the end faces defining the slot in the tube will mostly be supported directly against the support core in the stressed state, and preferably already in an unstressed state.

In the context of the other features described with reference to the present disclosure, but also alone and independently, protection is sought for a cosmetics applicator equipped with a core 2, bearing the application organs in the form of bristles 6 and/or comb teeth 10, 10', wherein the core 2 is formed by a slotted tube bearing bristles and/or comb teeth on its outer circumferential surface, wherein the bristles and/or comb teeth project outward from the inner circumferential surface and/or from the support core present in the interior of the slotted tube, the free ends of which protrude to the outside through the slot of the slotted tube.

BRIEF DESCRIPTION OF THE DRAWINGS

Further effects, advantages and possible design options of the applicators according to the present invention will be derived from the following embodiments described with reference to the drawings, wherein:

FIG. 9 is a greatly enlarged front view of a third embodiment of the applicator according to the present invention;

FIG. 10 is a diagonal top perspective view of the third embodiment;

FIG. 11 is a side view of the third embodiment;

FIG. 12 is a straight top view of the third embodiment;

DETAILED DESCRIPTION OF THE PREFERRED EMBODIMENTS

Figure 1:
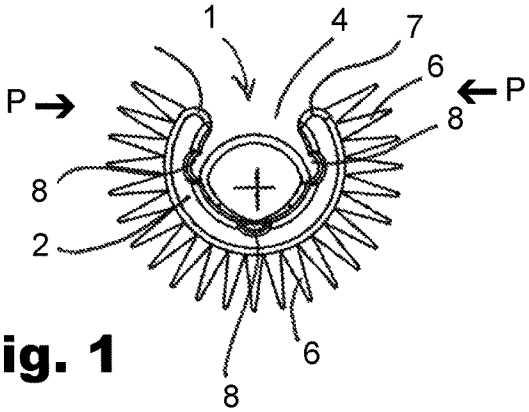
FIG. 1 shows a greatly enlarged front view of a first embodiment of the applicator according to the present invention.

In a general sense, the following applies to all embodiments of the present invention:

The applicator 1 comprises a coupling 5 for mounting the handle and/or shaft and a core 2, equipped with preferably injection-molded bristles 6 on its outer circumferential surface. The bristles usually protrude to the outside in an essentially radial direction. The core is in the form of a slotted tube. The tube has a longitudinal axis L around which the tube is preferably symmetrically arranged, if the slot is imagined to be omitted. The slot, or its edges, or the end faces 7 defining it, usually extend in a direction parallel to the longitudinal axis L.

Preferably, the end faces 7 of the tube, which form the edge of the slot 4 to be explained in more detail below, which interrupt the circumferential surface of the tube, also bear bristles 6. Ideally, a plurality of rows of bristles arranged one behind the other in the longitudinal direction are mounted on each of said end surfaces 7. For some applications, it can be particularly advantageous if the bristles protrude into the area of the slot 4 with at least one of said rows of bristles at each end surface 7, ideally in such a manner that an essentially closed bristle array results in the circumferential direction despite the presence of the slot 4.

Ideally, the end surfaces 7 are rounded. FIG. 1 illustrates this. The radius of curvature of the rounding ideally corresponds to about half the wall thickness of the tube forming the core.

On one side, the core 2 is connected to the shaft of the applicator, or the coupling section 5 provided for mounting on the shaft.

The bristles 6 ideally form rows of bristles along the entire core arranged one behind the other in the direction of the central longitudinal axis L along a straight line and simultaneously rows of bristles arranged one behind the other along a straight line in the circumferential direction. Each bristle is preferably slightly tapered, each of the straight lines along its circumferential surface preferably forming an angle $\alpha$ with longitudinal axis LB of between 0.5° and 3°, cf. FIG. 21.

Figure 21:
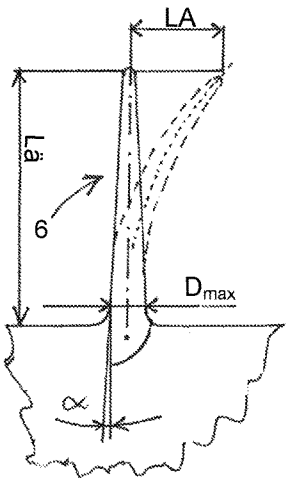
FIG. 21 explains details of the bristles on all exemplary embodiments with reference to an individual bristle.

Each of the bristles is preferably flexible in such a manner that its tip can be reversibly deflected by a distance LA preferably corresponding to at least four times, more preferably at least six times, the maximum bristle diameter measured above the rounding, at which the root of the bristle transitions into the core, cf. also FIG. 21. The length Lä of a bristle is preferably between 0.4 and 1.3 mm.

Unlike the prior-art applicators, the core 2 of the applicator according to the present invention is preferably not formed in such a solid manner that it is not subjected to any visible deformation as it passes through the stripper and/or the bottleneck.

Instead, the core of the present exemplary embodiment is formed as a tube having a hollow interior and slotted at its circumference over its entire length. Advantageously, the slot occupies about ⅛ to ⅓, more preferably only ⅛ to ¼ of the tube's circumference if a full tube which is fully closed is imagined.

The tube preferably has the cross-section of a slotted circular cylinder since this is the simplest way of ensuring uniform density of the applied bristles. The alternative of providing the tube with the cross-section of a slotted polygonal ring, such as a hollow hexagon or octagon, is also within the scope of the inventive claim, although the circular cylindrical tube is preferred. For many applications it is best if the tube has the cross-section of a slotted circular cylinder since this is the simplest way of ensuring uniform density of the applied bristles. A similar effect is achieved by a cross-section having the form of a slotted polygonal ring, such as a slotted hollow octagon.

For other applications again, it may be an alternative to provide the tube with the cross-section of a slotted, hollow ellipse, of a slotted, hollow oval shape or the cross-section of a U. This enables the easy provision of an applicator whose bristle density changes along its circumferential direction so that the applicator exhibits different application properties depending on which rotation position is brought into engagement with the place to be treated. Despite all this, however, the circular cross-section of the slotted tube remains the clearly preferred embodiment.

The interior of the tube, open to the environment through the slot preferably present on only one side of the circumference, generally forms a trough, which receives a certain amount of the cosmetic to be applied. Preferably, the tube is additionally open on its distal end face, i.e. the end facing away from the shaft or the coupling section 5, so that the deformation of the tube is not hindered in the area of the distal end face. The coupling section 5 is usually only fixed along a portion of the circumference of the tube to the latter, so that the deformation of the tube is not, at least not essentially, hindered in the area of the proximal end face.

The wall thickness of the entire tube, or the areas of the tube intended for deformation—which are those sections of the tube not directly linked to the coupling section 5 and thus resiliently protruding from the central body linked to the coupling section 5 and forming the backbone—is chosen in such a way that the two legs 3*a* and 3*b* defining the slot 4 between them can be displaced in the direction of arrows P towards each other in such a way that the diameter of the core and thus also the cross-sectional area. Q occupied by the core is reduced. The cross-sectional area Q occupied by the core is the area enclosed by the imagined path traced by a rope slung about the core from the outside.

The invention provides that the wall thickness and the material of the core are chosen in such a way that the above-described displacement of the legs occurs automatically under the influence of the forces exerted by the stripper and/or the neck of the reservoir on the core as soon as the core is withdrawn through the stripper or the bottleneck in accordance with its intended use or is inserted in the reverse direction back into the reservoir. The legs 3*a* and 3*b* need not be deformed over their entire lengths. Rather, in most cases they will only be deformed where they are directly subjected to the compressive forces of the stripper and/or the bottleneck.

In this way, an applicator can be provided having, in the application-ready state, a core 2 with an exceptionally large core diameter D, wherein preferably D>3.5 mm; ideally, D is even ≥4.5 mm. Despite the exceptionally large core diameter D, in many cases it is not necessary to use cosmetics receptacles with a particularly wide bottleneck and/or a stripper with a particularly large free diameter for the applicator. Rather, the core 2 "folds up" or "curls" as it passes through the stripper or the bottleneck and thus behaves like a core with a smaller core diameter D at this moment.

Ideally, according to the present invention, the tube has a constant wall thickness outside of the weakening grooves, at least in the circumferential direction, preferably, however, in all places outside of the weakening grooves, which is chosen in such a way that the entire tube forms a spring in the circumferential direction. In this way, strong spring action can be ensured in the easiest way. In the present context "constant" will be understood to be in the broadest sense deviations of the wall thickness of +/−7.5%, in a narrower sense, permissible tolerances are only +/−2%.

It should be noted that the present invention is not centered around such material deformations arising as inevitable small or micro-deformations whenever one physical body exerts forces on the other. Rather, the present invention relates to deformations resulting in a clearly discernible effect, i.e. preferably such deformations which reduce the cross-sectional area Q of the core by at least 10%, more preferably by about 20%.

In this regard, the bristles and the core are adapted to each other. The core is designed such that it resiliently gives even before the forces arising as it passes through the stripper and/or the bottleneck become sufficiently large to bend the bristles in such a severe fashion that they are damaged. There is no universal mathematic formula for the observation of this rule. Rather, a reasonable number of tests typical for this field, if necessary supported by FGM calculations, are required to ensure that the individual core is designed such that after it has been provided with the specifically designated bristles it cooperates with a certain stripper and/or a certain bottleneck in terms of the above requirement. Again, it has to be considered that the applicators according to the present invention are typically disposable articles, and be it only for reasons of hygiene. In view of this, it may even be sufficient for the bristles to show no visible damage during the typical duration of their service life in the intended application.

After these general explanations, let us now turn to the individual exemplary embodiments.

First Exemplary Embodiment

FIGS. 1 to 4 show a first exemplary embodiment.

It is quite clear that the slotted tube has three so-called weakening grooves at its inner circumference, see, in particular FIG. 1. Each of the weakening grooves extends preferably over the entire length of the inside of the tube, see FIG. 2. The two weakening grooves 8 adjacent to the slot 4 are approximately diametrically opposed with reference to the imagined central longitudinal axis of the slotted tube, cf. FIG. 1. The third weakening groove is preferably at the bottom-most portion of the slotted tube if the slot is imagined to be the top of the tube. A weakening groove is preferably a groove having a width of a maximum of 3 mm, more preferably a maximum of 2 mm recessed in the surrounding inner surface of the slotted tube.

Preferably the 3 weakening grooves 8 are offset from each other along the circumference of the tube by about 90°.

Each of the weakening grooves 8 has a cross-sectional profile preferably in the shape of a circular curve or a U.

Ideally, each weakening groove weakens the wall thickness of the slotted tube by at least 30% in the radial direction.

Figure 5:
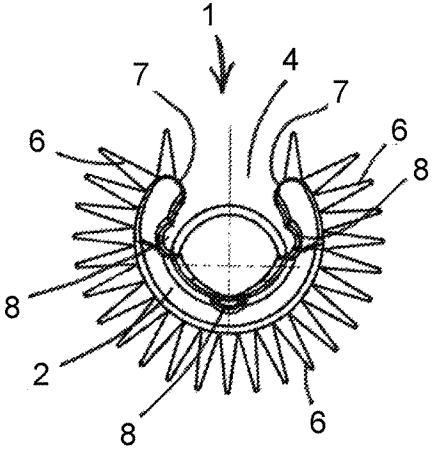
FIG. 5 is a greatly enlarged front view of a second embodiment of the applicator according to the present invention.
Figure 6:
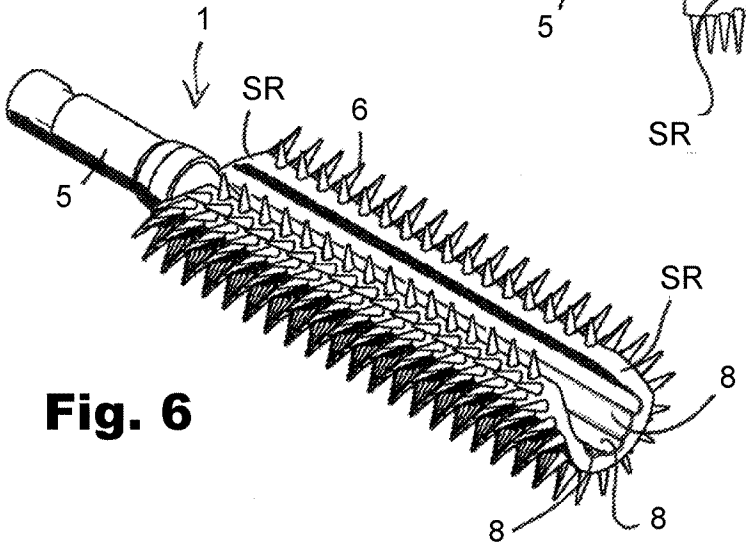
FIG. 6 is a diagonal top perspective view of the second embodiment.
Figure 15:
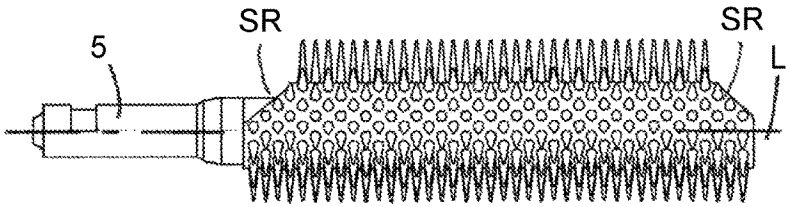
FIG. 15 is a side view of the fourth embodiment.
Figure 16:
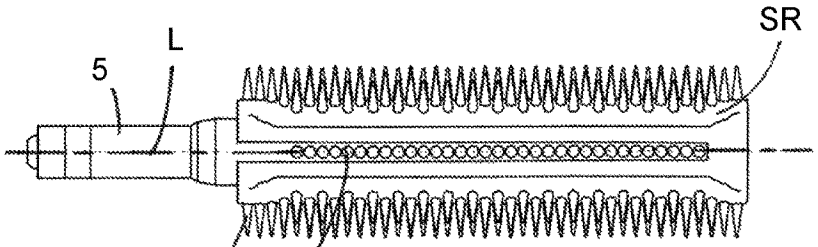
FIG. 16 is a straight top view of the fourth embodiment.
Figure 13:
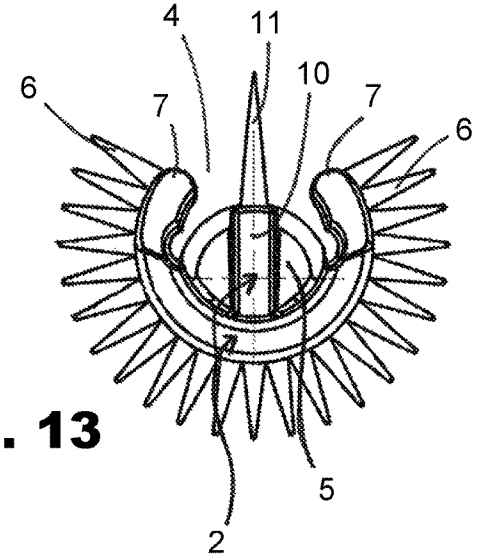
FIG. 13 is a greatly enlarged front view of a fourth embodiment of the applicator according to the present invention.

In this way the wall of the slotted tube remaining in the area of the weakening groove becomes a kind of hinge, facilitating the curling of the tube under the influence of forces acting on the tube from the outside, such as those exerted by the stripper, for example. This does not mean that those wall areas of the slotted tube adjacent to the weakening grooves in the circumferential direction, do not deform and do not contribute to the curling action. It is preferable, however, that this "curling" action is predominantly caused by the weakening grooves. FIGS. 5*a* and 5*b*, to which reference is made in advance, schematically show how this curling action works.

Figure 3:
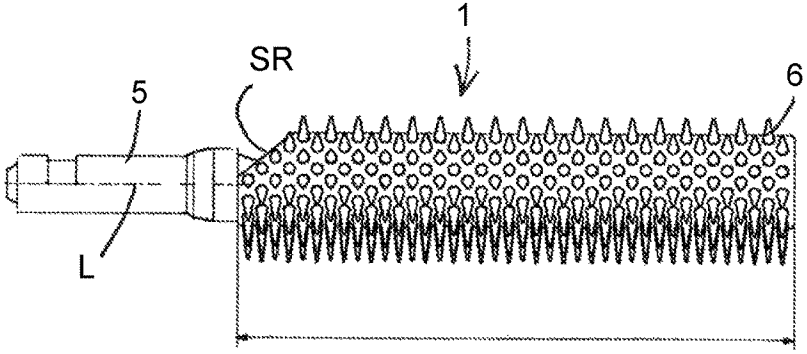
FIG. 3 is a side view of the first embodiment.
Figure 4:
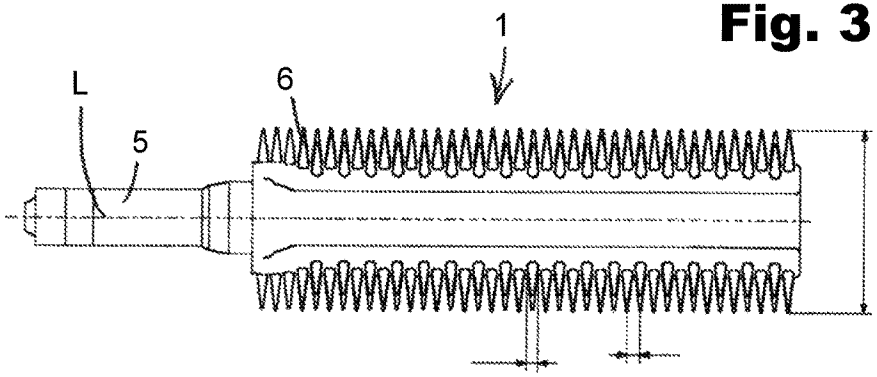
FIG. 4 is a straight top view of the first embodiment.
Figure 2:
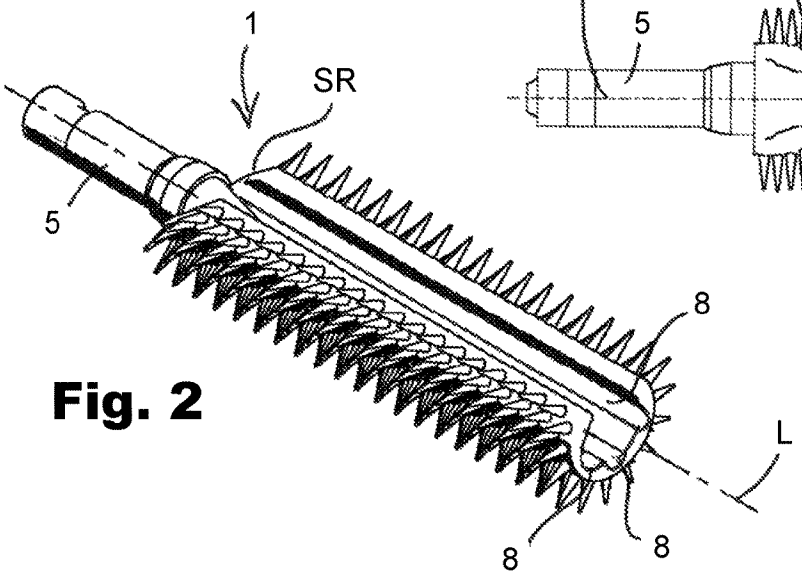
FIG. 2 is a diagonal top perspective view of the first embodiment.
Figure 7:
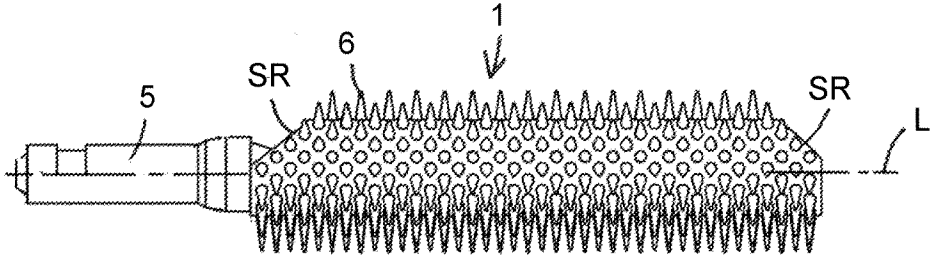
FIG. 7 is a side view of the second embodiment.
Figure 8:
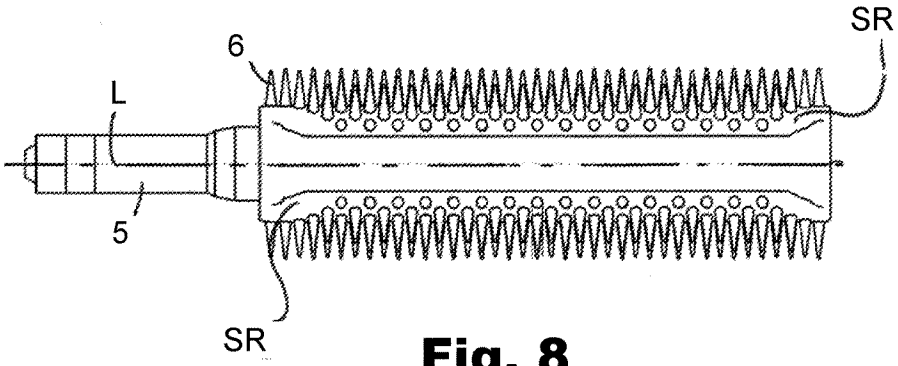
FIG. 8 is a straight top view of the second embodiment.

As can be seen clearly from FIGS. 2 and 3, the slotted tube is obliquely cut away at least in the area of its proximal end, that is the end facing the handle, not shown. This oblique cut of the tube has the effect that the curling action of the tube is more easily initiated as the applicator is withdrawn from the reservoir, when the ramp SR of the slotted tube engages the bottleneck or the stripper present therein.

Second Exemplary Embodiment

FIGS. 5 to 8 show a second exemplary embodiment.

The first and second exemplary embodiments are almost entirely identical so that the explanations given for the first embodiment also apply to the second exemplary embodiment.

The only difference between these two exemplary embodiments is that the second exemplary embodiment has a slotted tube which is also obliquely cut in the area of its distal end, that is the end, not shown, facing away from the handle, thus having a ramp SR at the front and back. In this way, reintroducing the applicator into the reservoir through the stripper or bottleneck is also made somewhat easier.

The second difference is that, in the first exemplary embodiment, the end faces 7 forming the edge of the slot are preferably not equipped with bristles, while the end faces 7 forming the edge of the slot of this second exemplary embodiment preferably have at least, and ideally, only one row of bristles aligned along the longitudinal axis L one behind the other in a straight line.

To the left and right of the weakening groove diametrically opposed to the slot 4, the slotted tube forms two legs. Preferably, these two legs approach each other under stress due to the weakening groove 8 forming a type of hinge in the broadest sense.

It can also be seen very clearly how each of the 2 legs extending away from the above central weakening groove is each subdivided in turn by at least one further weakening groove. In this way, each of the two legs forms a subsection which is displaced even further to the inside, i.e. curls even more, under the influence of forces acting from the outside, due to a bottleneck or a stripper for example.

A characteristic of the curling action is the imagined rope line which is slung about the outer circumference of the slotted tube in the spaces between the bristles and which becomes shorter the more the applicator is curled, or "folded".

Third Exemplary Embodiment

FIGS. 9 to 12 show a third exemplary embodiment.

If not stated differently in the following descriptions of differences which this third exemplary embodiment exhibits against the hitherto described exemplary embodiments, the explanations given for the above exemplary embodiments also apply to the present third exemplary embodiment.

The present exemplary embodiment only has two weakening grooves 8, each formed and effective in the same way as described for the first two exemplary embodiments.

Preferably, the present weakening grooves 8 are also diametrically opposed.

Preferably at the bottom-most point of the slotted tube, as already defined in the context of the first exemplary embodiment, the applicator 1 is provided with a support core 10, which is in the form of a preferably cylindrical rod in the present exemplary embodiment, whose diameter is smaller than the inner diameter of the slotted tube so that the support core 10 preferably fills a maximum of 35% of the cross-sectional area surrounded by the slotted tube so that the intended curling of the tube is not hindered. In the present exemplary embodiment, the core 2 thus consists of the slotted tube and additionally of the support core.

The preferably cylindrical rod forming the support core 10, at one point of its outer circumference, transitions into the inner circumference of the slotted tube and becomes one with the slotted tube, which does not mean, however, as clearly seen from the figures, that the support core is completely integrated in the slotted tube and thus only represents a component part with only imaginary presence in the slotted tube. The part of the circumference of the support core 10 which integrally transitions into the slotted tube corresponds to a segment of about 80 to 120°. The support core 10 preferably extends at least over most of the length of the slotted tube along its longitudinal axis L. The greatest part of the surface of the support core is independent from and positioned further to the inside than the inner surface of the slotted tube.

Ideally, the support core 10 and the coupling section 5 form an integral part made of a single, first plastic material. They are normally molded in one shot. The slotted tube and the bristles 6, which it has on its outer circumference, are then molded on top. The slotted tube and the bristles 6 are preferably of a second, different plastic material. Usually the second plastic material will be more easily deformable, softer and/or more elastic then the first plastic material. In this way there is a sharing of tasks, as it were—the support core 10 ensures sufficient stability during application so that the applicator remains largely stiff along its longitudinal axis L ensuring that no problems occur, for example, when the applicator is pulled through a stripper, which at times requires a not unsubstantial amount of force. Compared to the support core, the slotted tube is flexible, so that the slotted tube can easily curl to a sufficient extent in the circumferential direction as it passes through the stripper or the bottleneck.

The physical structure of the transition between the inner circumference of the slotted tube and the outer circumference of the support core 10 is worthy of note. Bonding of the first and second plastic materials by means of over-molding results in fusing and/or adhesive bonding in the area of this transition which, as viewed under the microscope, is typical for a plastic material in the liquid molten state coming into contact under pressure with another plastic material, which is at least partially solidified.

Fourth Exemplary Embodiment

FIGS. 13 to 16 show a fourth exemplary embodiment which basically corresponds to the third exemplary embodiment, so that the explanations given there also apply to the present fourth exemplary embodiment, including the structural details which were described for the first and second exemplary embodiments and which, as is clearly discernible, are also present here.

It can be seen quite clearly that in the present exemplary embodiment, again, only two weakening grooves 8 are provided, which correspond in their structure and function to those weakening grooves 8 described with reference to the first and second exemplary embodiments.

Figure 14:
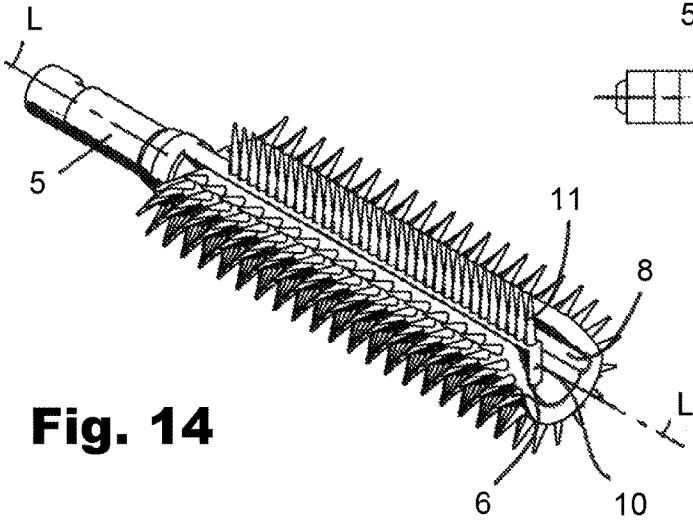
FIG. 14 is a diagonal top perspective view of the fourth embodiment.

The support core 10, however, is not formed as a cylindrical rod but as a slat preferably having a rectangular cross-section. Similar to the rod-like support core of the preceding exemplary embodiment, the slat is linked to the coupling section 5 preferably with its entire proximal end face, as best seen in FIG. 14. Again, the slat extends in the direction of the longitudinal axis over most of the length of the slotted tube, in the present case even over its entire length.

Again, it applies that the support core 10 in the form of a slat of the first plastic material forms an integral part with the coupling section 5. Particularly preferably, the slat is provided with at least one row of bristles or comb teeth 11 preferably aligned in a straight line one behind the other. These comb teeth 11 protrude through the slot 4 in the slotted tube to the outside to such an extent that they can perform their combing function. The pitch of the comb teeth 11 in the direction along the longitudinal axis L is preferably chosen to be smaller than the foot diameter of the comb teeth. The comb teeth 11 are preferably tapered. Sufficient free space is provided between the comb teeth and the end faces 7 forming the edge of the slot to ensure that the slotted tube can perform the intended curling action as it passes through the bottleneck and/or stripper.

It only remains to be pointed out that such comb teeth 11 can, of course, not only be present if the support core has a square or rectangular cross-section. Rather, such comb teeth could also be provided on a support core having a cylindrical cross-section as described with reference to the third exemplary embodiment.

Fifth Exemplary Embodiment

FIGS. 17 to 20 show an exemplary embodiment having a very special support core.

Figure 17:
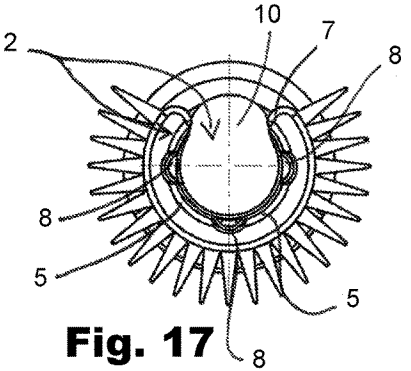
FIG. 17 is a greatly enlarged front view of a fifth embodiment of the applicator according to the present invention.
Figure 19:
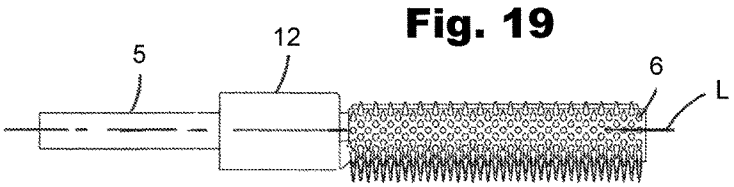
FIG. 19 is a side view of the fifth embodiment.
Figure 20:
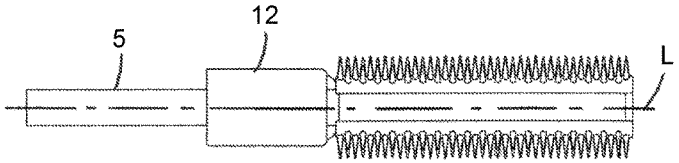
FIG. 20 is a straight top view of the fifth embodiment.
Figure 18:
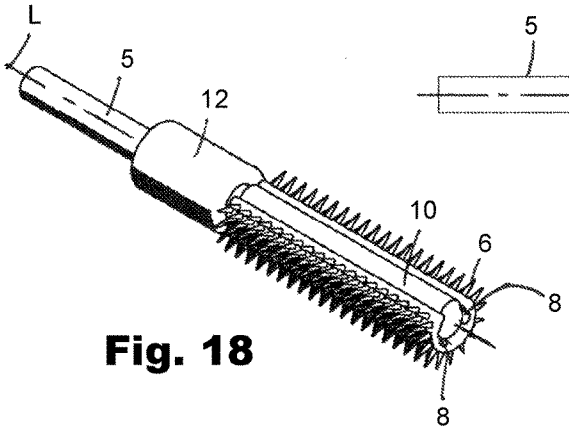
FIG. 18 is a diagonal top perspective view of the fifth embodiment.

This support core 10 according to FIG. 17 has a diameter that is large enough to fill almost the entire cross-section surrounded by the slotted tube. A gap S remains, however, between the support core and the slotted tube so that the slotted tube is as flexible as before in particular in the radial direction, even though it is no longer able to curl in the present exemplary embodiment but only able to resiliently give in the radial direction—which is again facilitated by the clearly discernible weakening grooves 10, which are present in the same number and distribution in the present exemplary embodiment as in the first exemplary embodiment.

The end faces 7 forming the edge of the slot of the slotted tube are preferably supported on their innermost edge against the support core, which protrudes through the slot, see FIG. 17.

Again, preferably, the slotted tube and the bristles 6 supported thereon are of a second, more flexible or more elastic and/or soft plastic material and the support core 10 of a comparatively harder, first plastic material. It is particularly advantageous in the present exemplary embodiment, if the second plastic material is a soft, elastic or even a rubber-elastic plastic material.

As is shown, the support core 10 has preferably a drop-like or pear-shaped cross-sectional shape.

The support core 10, in turn, can be equipped with bristles or comb teeth where it protrudes to the outside through the slot 7.

It should also be noted that the applicator of the present exemplary embodiment can be equipped with a thickened section 12 extending from the bristles in the direction of the longitudinal axis in the proximal direction and which is intended to interact with the stripper in a particular way and in particular to prevent excessive stripping by forcing the stripper to be expanded by a minimum amount.

Sixth Exemplary Embodiment

Figure 23:
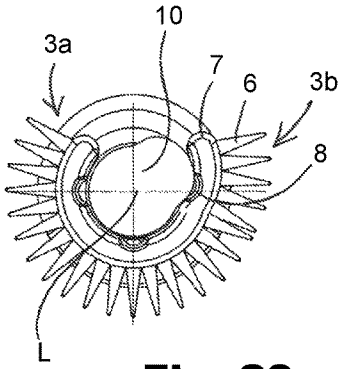
FIG. 23 is a greatly enlarged front view of a sixth embodiment of the applicator according to the present invention in a second adjusted position.
Figure 24:
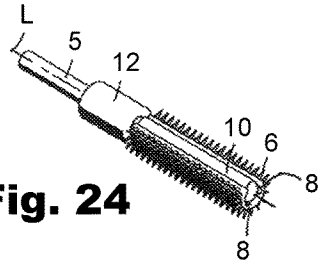
FIG. 24 is a diagonal top perspective view of the embodiment according to FIGS. 22 and 23.
Figure 22:
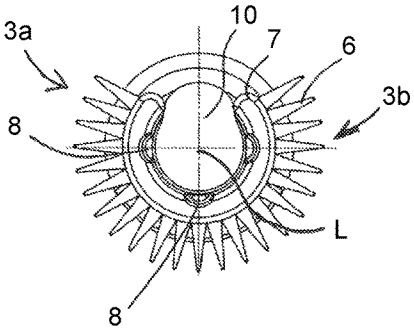
FIG. 22 is a greatly enlarged front view of a sixth embodiment of the applicator according to the present invention in a first adjusted position.

FIGS. 22 to 24 show an exemplary embodiment which corresponds to the fifth exemplary embodiment. The difference is that the support core is rotatable. The explanations given with reference to the fifth exemplary embodiment therefore also apply to the present sixth exemplary embodiment unless the rotatability of the support core requires a different design.

As is clearly shown, the support core 10 is now rotatably supported in the thickened section 12, see FIG. 24.

In the area of the trough, or the free space enclosed between the legs 3*a*, 3*b*, the support core 10 is designed in such a way that it has the effect of a rotatable eccentric. For this reason, in the position in which it does not exhibit a wedging action, it protrudes into the area of the slot left open between the legs 3*a* and 3*b*, or through the slot to the outside.

If the support core 10 is now twisted from its neutral position shown in FIG. 22 to the left or right, such as into the position shown in FIG. 23, due to its eccentricity, it will force the leg in question 3*a* or 3*b* to the outside.

This changes the bristle pitch in the affected area and thus the application behavior. This allows new effects to be achieved hitherto impossible with prior-art applicators.

Again, it is particularly advantageous if the support core 10 is of a harder or less flexible material than the legs 3*a* or 3*b*. The latter are preferably at least partially of a soft elastic or even rubber-elastic plastic material.

Again, the at least one slot 4 is particularly advantageous because it reduces the forces necessary to perform adjustment by means of the support core 10.

It is particularly suitable if at least one slot 4 is designed in such a way that the support core can snap engage in it and thus not automatically return from its position shown in FIG. 23 into the position shown in FIG. 22. In this way the user can acquire an applicator having a different application behavior by a single exertion of force, with no need to uphold it.

Generally and in summary, it can be said that particular and independent protection is sought for a cosmetics applicator having the following features:

A cosmetics applicator 1 comprising a core bearing the application organs in the form of bristles 6 and/or comb teeth 10, 10', wherein the core 2 is formed by a slotted tube equipped with bristles and/or comb teeth on its outer circumferential surface, characterized in that an eccentric is arranged within the slotted tube flaring or not flaring the tube, or particularly preferably, more strongly flaring or less strongly flaring the tube, to the outside as a function of its rotary position.

It is particularly advantageous if the eccentric can be locked in a position in which it flares the tube.

Ideally, the slotted tube comprises grooves extending in a direction parallel to its longitudinal axis which weaken the tube and thus facilitate deformation by means of the eccentric.

It can be provided that the grooves are made on the inside and formed in such a way that the eccentric can snap engage in them.

It is particularly advantageous if the eccentric is of a harder or less elastic material than the slotted tube.

It is applicable to all exemplary embodiments described here that the slotted tube can advantageously optionally be injection molded of two components. Ideally, the portion forming its inner circumferential surface is formed of a harder plastic material while the section forming its outer circumferential surface is of a softer plastic material, ideally also integrally forming bristles/comb teeth with it.

In particular, completely independently of other claims, protection is sought for a cosmetics applicator comprising a core bearing the application organs in the form of bristles and/or comb teeth 11, wherein the core is formed by a slotted tube and optionally additionally a support core 10, and the tube is equipped with bristles 6 and/or comb teeth 11 on its outer circumferential surface, wherein bristles 6 and/or comb teeth 11 project outwards from the inner circumferential surface and/or from the support core 10 present in the interior of the slotted tube, the free ends of which protrude to the outside through the slot of the slotted tube.

In particular, completely independently of other claims, protection is sought for a cosmetics applicator comprising a core 2 bearing the application organs in the form of bristles 6 and/or comb teeth 11, wherein the core 2 is formed by a slotted tube equipped with bristles 6 and/or comb teeth 11 on its outer circumferential surface, wherein a support core 10 is arranged in the slotted tube, in such a way that a partial annular gap S is formed between the outer circumference of the support core 10 and the inner circumference of the slotted tube, and wherein the slotted tube preferably comprises at least one weakening groove 8 extending in a direction parallel to the longitudinal axis L of the tube.

In particular, completely independently of other claims, protection is sought for a cosmetics applicator comprising a core and bristles 6 outwardly protruding therefrom, and characterized in that the core is formed by a slotted tube or consists of a rod-like central body, from which at least one leg protrudes, and the core is at least partially resilient in such a manner that the cross-sectional area occupied by the core during passage through the stripper and/or the bottleneck of the cosmetics reservoir associated with the cosmetics applicator is automatically reversibly reduced under the influence of the forces exerted by the stripper and/or the bottleneck of the cosmetics reservoir.

The embodiment mentioned in the last paragraph can be refined by the leg protruding from the rod-like central body being equipped with bristles and being elastic in such a way that it is reversibly offset in the direction towards the central area of the core under the influence of the forces exerted by the stripper and/or the bottleneck of the cosmetics reservoir.

The invention claimed is:

1. A cosmetics applicator, comprising:

a slotted tube having a cut-out slot through a wall into an interior of the tube that extends along a full length of the tube parallel to a longitudinal axis of the tube, wherein the slotted tube has two legs defined by the cut-out slot that separates the two legs;

a plurality of bristles, comb teeth, or a combination of bristles and comb teeth on an outer circumferential surface of the slotted tube and extending radially outward from the outer circumferential surface of the slotted tube; and a rotatable support core arranged within the slotted tube, wherein the rotatable support core is a non-cylindrical eccentric that rotates within the tube interior directly against the legs of the slotted tube, and the rotatable support core is configured for flaring and not flaring the legs of the tube as a function of its rotary position.

2. The cosmetics applicator according to claim 1, wherein the slotted tube comprises at least one weakening groove extending in a direction parallel to the longitudinal axis of the tube, which facilitates expansion of the tube by rotation of the rotatable support core arranged within the tube.

3. The cosmetics applicator according to claim 2, wherein at least two weakening grooves are present extending parallel to the longitudinal axis.

4. The cosmetics applicator according to claim 3, wherein the at least two weakening grooves are essentially diametrically opposed to each other on a tube circumference with respect to an imaginary central axis of the tube.

5. The cosmetics applicator according to claim 4, wherein the diametrically opposed weakening grooves separate two wing-like tube segments from the rest of the tube, wherein one segment is the mirror image of the other segment and the two segments are otherwise identical.

6. The cosmetics applicator according to claim 5, wherein the slotted tube is composed of a first plastic material and the eccentric is composed of a different, second plastic material, and wherein the first plastic material is more flexible than the second plastic material.

7. The cosmetics applicator according to claim 6, wherein the legs of the slotted tube are at least partially composed of a soft elastic plastic material or a rubber material.

8. The cosmetics applicator according to claim 2, wherein the at least one groove is designed in such a way that the eccentric can snap engage in the groove and thus can not automatically turn back.

9. A cosmetics applicator, comprising:

a core consisting of a slotted tube having a cut-out slot through a wall into an interior of the tube that extends along a full length of the tube parallel to a longitudinal axis of the tube, wherein the slotted tube has two legs defined by the cut-out slot that separates the two legs;

a plurality of bristles, comb teeth, or a combination of bristles and comb teeth on an outer circumferential surface of the slotted tube and extending radially outward from the outer circumferential surface of the slotted tube; and a rotatable support core arranged within the slotted tube, wherein the rotatable support core is a non-cylindrical eccentric that rotates within the tube interior directly against the legs of the slotted tube, and the rotatable support core is capable of flaring and not flaring the legs of the tube as a function of its rotary position.

* * * * *